US006102523A

United States Patent [19]

Desie et al.

[11] Patent Number: 6,102,523

[45] Date of Patent: Aug. 15, 2000

[54] PRINTER FOR LARGE FORMAT PRINTING USING A DIRECT ELECTROSTATIC PRINTING (DEP) ENGINE

[75] Inventors: Guido Desie, Herent; Jacques Leonard, Antwerp; Hilbrand Van den Wijngaert, Grobbendonk, all of Belgium

[73] Assignee: Agfa-Gevaert, Mortsel, Belgium

[21] Appl. No.: 08/994,093

[22] Filed: Dec. 19, 1997

Related U.S. Application Data

[60] Provisional application No. 60/038,767, Feb. 20, 1997.

[30] Foreign Application Priority Data

Nov. 17, 1997 [GB] United Kingdom ..... 96203635

[51] Int. Cl.[7] ..... B41J 2/06; G03G 15/08; G03G 15/16

[52] U.S. Cl. ..... 347/55; 399/290; 399/266

[58] Field of Search ..... 347/55, 154, 103, 347/123, 111, 159, 127, 128, 17, 141, 120, 151; 399/271, 290, 292, 293, 294, 295, 266, 265

[56] References Cited

U.S. PATENT DOCUMENTS

| | | | |
|---|---|---|---|
| 3,689,935 | 9/1972 | Pressman et al. | 346/74 |
| 4,804,979 | 2/1989 | Kamas et al. . | |
| 4,814,796 | 3/1989 | Schmidlin . | |
| 4,864,328 | 9/1989 | Fischbeck . | |
| 4,897,677 | 1/1990 | Lai . | |
| 4,922,271 | 5/1990 | Nilsson et al. . | |
| 4,940,998 | 7/1990 | Asakawa . | |

(List continued on next page.)

FOREIGN PATENT DOCUMENTS

| | | |
|---|---|---|
| 0526205 A2 | 7/1992 | European Pat. Off. . |
| 0526205A2 | 7/1992 | European Pat. Off. . |
| 0708386 A1 | 10/1994 | European Pat. Off. . |
| 0708386A1 | 10/1994 | European Pat. Off. . |
| 0710897 A1 | 11/1994 | European Pat. Off. . |
| 0710897A1 | 11/1994 | European Pat. Off. . |
| 0710898 A1 | 11/1994 | European Pat. Off. . |
| 0710898A1 | 11/1994 | European Pat. Off. . |
| 0675417 A1 | 3/1995 | European Pat. Off. . |
| 0675417A1 | 3/1995 | European Pat. Off. . |
| 0731394 A1 | 3/1995 | European Pat. Off. . |
| 0731394A1 | 3/1995 | European Pat. Off. . |
| 0736822 A1 | 3/1996 | European Pat. Off. . |
| 0736822A1 | 3/1996 | European Pat. Off. . |
| 0740224 A1 | 4/1996 | European Pat. Off. . |
| 0740224A1 | 4/1996 | European Pat. Off. . |
| 0712056 | 5/1996 | European Pat. Off. . |
| 0740224 | 10/1996 | European Pat. Off. . |
| 19540138 | 1/1984 | Germany . |
| 62164083 | 7/1987 | Japan . |
| 05011425 | 1/1993 | Japan . |
| 408104025A | 4/1996 | Japan . |
| 9218948 | 10/1992 | WIPO . |
| 9601489 | 1/1996 | WIPO . |
| 9618506 | 6/1996 | WIPO . |

*Primary Examiner*—John Barlow
*Assistant Examiner*—Raquel Yvette Gordon
*Attorney, Agent, or Firm*—Baker Botts L.L.P.

[57] ABSTRACT

A printer, with printing width (PW), is provided, for printing toner image on a substrate, having a width (WS) and a length (LS), comprising a DEP printing engine, having a toner delivery means, having a surface whereon charged toner particles are present for providing a flow of the toner particles from that surface to the substrate, a printhead structure with printing apertures and control electrodes, interposed in the flow of toner particles for image-wise controlling that flow, wherein:

the toner delivery means comprises a number, n equal to or larger than 2, of toner applicator modules, each having a width, WTD, smaller than the printing width PW, and at least two of the number, n of toner applicator modules are positioned in a staggered configuration with respect to the substrate.

Preferably the printing width of the printer is at least 40 cm.

17 Claims, 5 Drawing Sheets

U.S. PATENT DOCUMENTS

| | | | |
|---|---|---|---|
| 4,996,556 | 2/1991 | Gray, Jr. | 355/50 |
| 5,036,341 | 7/1991 | Larson . | |
| 5,132,708 | 7/1992 | Schmidlin et al. | 346/157 |
| 5,132,712 | 7/1992 | Fletcher et al. . | |
| 5,138,336 | 8/1992 | Goto . | |
| 5,202,704 | 4/1993 | Iwao . | |
| 5,204,696 | 4/1993 | Schmidlin et al. . | |
| 5,237,347 | 8/1993 | Teshigawara et al. . | |
| 5,257,046 | 10/1993 | Schmidlin . | |
| 5,283,594 | 2/1994 | Iwao | 346/159 |
| 5,327,169 | 7/1994 | Thompson . | |
| 5,353,050 | 10/1994 | Kagayama . | |
| 5,359,147 | 10/1994 | Satoh | 118/653 |
| 5,428,375 | 6/1995 | Simon et al. . | |
| 5,477,250 | 12/1995 | Larson | 347/55 |
| 5,539,438 | 7/1996 | Maeda . | |
| 5,552,862 | 9/1996 | Masuda et al. | 355/208 |
| 5,677,719 | 10/1997 | Granzow . | |
| 5,714,992 | 2/1998 | Desie | 347/55 |
| 5,754,198 | 5/1998 | Nishikawa . | |
| 5,781,217 | 7/1998 | Desie . | |
| 5,871,292 | 2/1999 | Johnson et al. . | |

PRINTER FOR LARGE FORMAT PRINTING USING A DIRECT ELECTROSTATIC PRINTING (DEP) ENGINE

Provisional Application No. 60/038,767 filed Feb 20, 1997.

FIELD OF THE INVENTION

This invention relates to a printing apparatus for large format printing with electrostatic printing means and more particularly with Direct Electrostatic Printing (DEP) printing means. In DEP, electrostatic printing is performed directly from a toner delivery means on a receiving member substrate by means of an electronically addressable printhead structure.

BACKGROUND OF THE INVENTION.

In DEP (Direct Electrostatic Printing) the toner or developing material is deposited directly in an image-wise way on a receiving substrate, the latter not bearing any image-wise latent electrostatic image. In the case that the substrate is an intermediate endless flexible belt (e.g. aluminium, polyimide etc.), the image-wise deposited toner must be transferred onto another final substrate. If, however, the toner is deposited directly on the final receiving substrate, a possibility is fulfilled to create directly the image on the final receiving substrate, e.g. plain paper, transparency, etc. This deposition step is followed by a final fusing step.

This makes the method different from classical electrography, in which a latent electrostatic image on a charge retentive surface is developed by a suitable material to make the latent image visible. Further on, either the powder image is fused directly to said charge retentive surface, which then results in a direct electrographic print, or the powder image is subsequently transferred to the final substrate and then fused to that medium. The latter process results in an indirect electrographic print. The final substrate may be a transparent medium, opaque polymeric film, paper, etc.

DEP is also markedly different from electrophotography in which an additional step and additional member is introduced to create the latent electrostatic image. More specifically, a photoconductor is used and a charging/exposure cycle is necessary.

Direct electrostatic printing is also quite different from ionography where an electrostatic latent image is formed on a charge retentive surface either by image-wise applying charges (ions) on that surface, or by image-wise neutralising charges on a uniformly charged charge retentive surface by image-wise discharging the surface by applying charges of different polarity (ions of different polarity). This latent image is then, as in classical electrophotography, developed by charged toner particles.

A DEP device is disclosed in, e.g., U.S. Pat. No. 3,689,935. This document discloses an electrostatic line printer having a multi-layered particle modulator or printhead structure comprising:

- a layer of insulating material, called isolation layer
- a shield electrode consisting of a continuous layer of conductive material on one side of the isolation layer;
- a plurality of control electrodes formed by a segmented layer of conductive material on the other side of the isolation layer and
- at least one row of apertures.

Each control electrode is formed around one aperture and is isolated from each other control electrode.

Selected potentials are applied to each of the control electrodes while a fixed potential is applied to the shield electrode. An overall applied propulsion field between a toner delivery means and a receiving member support projects charged toner particles through a row of apertures of the printhead structure. The intensity of the particle stream is modulated according to the pattern of potentials applied to the control electrodes. The modulated stream of charged particles impinges upon a receiving member substrate, interposed in the modulated particle stream. The receiving member substrate is transported in a direction perpendicular to the printhead structure, to provide a line-by-line scan printing. The shield electrode may face the toner delivery means and the control electrode may face the receiving member substrate. A DC field is applied between the printhead structure and a single back electrode on the receiving member support. The propulsion field is responsible for the attraction of toner to the receiving member substrate that is placed between the printhead structure and the back electrode. The printing device as described in U.S. Pat. No. 3,689,935 is very sensitive to changes in distances from the toner application module towards said shield electrode, leading to changes in image density. For that reason it is very difficult to construct a printer for large format printouts.

Multi-applicator module printing systems have been disclosed, but only with the construction of different application modules perpendicular in the printing direction, leading to the possibility of obtaining a single pass multi-colour printer. Such descriptions have been given in e.g. U.S. Pat. No. 5,132,708, U.S. Pat. No. 5,283,594 and U.S. Pat. No. 5,477,250.

The teachings of these disclosures however, do not give a solution to the problem of printing large format images with sufficient image quality and printing speed.

There is thus still a need for a DEP printing system yielding reliable and stable images of large image size with a fast printing speed.

OBJECTS AND SUMMARY OF THE INVENTION

It is an object of the invention to provide a printer for large format printing, using a Direct Electrostatic Printing (DEP) printing engine.

It is a further object of the present invention to provide a printer for large format printing, using a Direct Electrostatic Printing (DEP) printing engine, for printing large format images with a high printing speed.

It is a further object of the invention to provide a printer, using a DEP device, combining large format printouts at a high printing speed with good long term stability and reliability.

Further objects and advantages of the invention will become clear from the description hereinafter.

The above objects are realised by providing a printer, with printing width PW, for printing a toner image on a substrate, said substrate having a width, WS, and a length, LS, comprising a DEP printing engine, having

- a toner delivery means, having a surface whereon charged toner particles are present for providing a flow of said toner particles from said surface to said substrate,
- a printhead structure with printing apertures and control electrodes, interposed in said flow of toner particles for image- wise controlling said flow, wherein:
  - i) said toner delivery means comprises a number of n toner applicator modules, each having a width, WTD, smaller than said printing width PW, ii) said number n of said toner applicator modules is equal to or larger than 2, and iii) at least two of said number n of toner applicator modules are positioned in a staggered configuration with respect to said substrate.

DEFINITIONS

Figure 1:
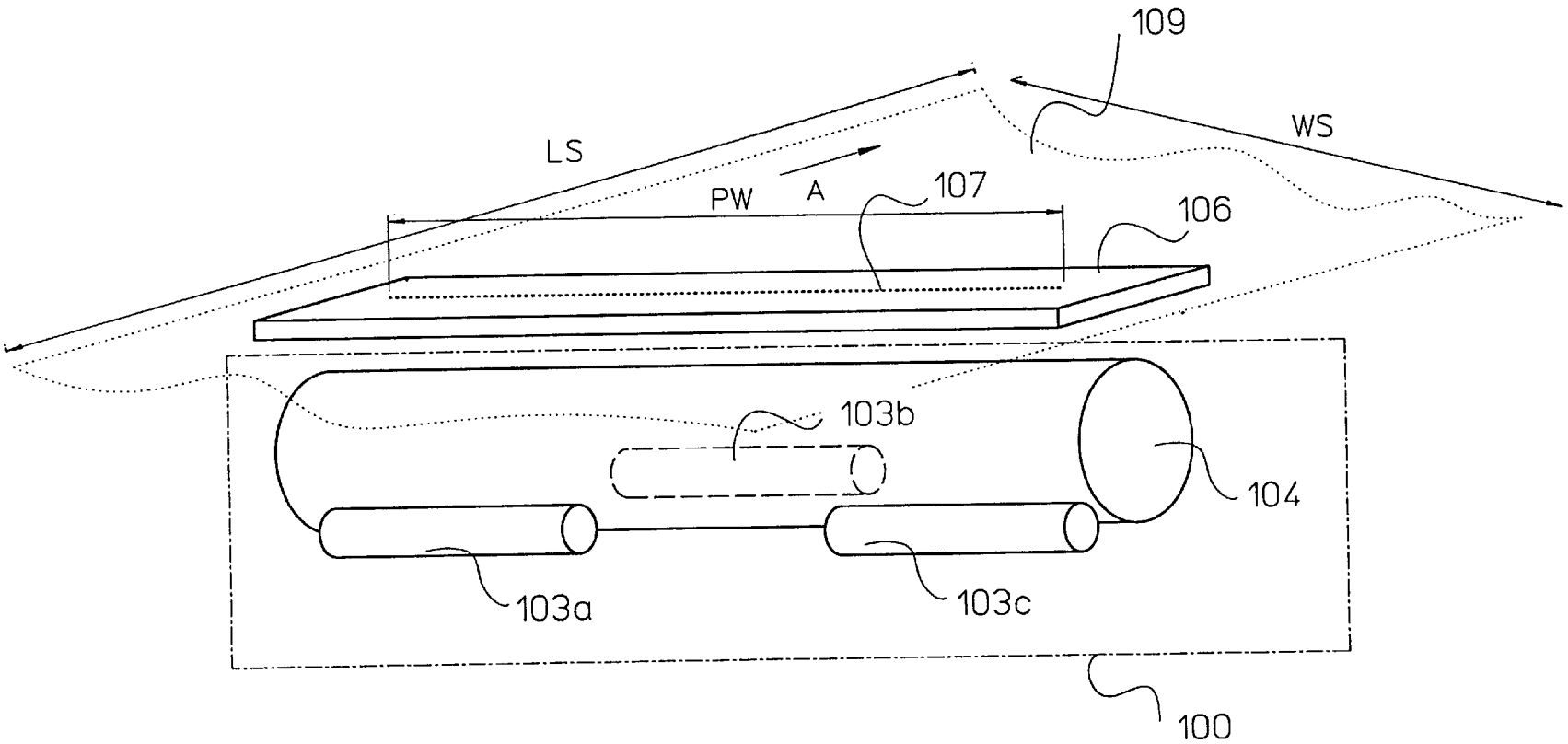
FIG. 1 is a schematic perspective view of a possible configuration of a printer according to a first specific embodiment of the present invention.

In this document the wording "toner delivery means" is used to designate those parts of a DEP printing engine comprising a surface carrying developer with charged toner particles and that is used for creating, in an electric field, a cloud or flow of charged toner particles from the surface carrying the developer in the direction of an image receiving substrate. E.g., when this flow originates from a layer of charged toner particles present on the surface of a "charged toner conveyor" then this "charged toner conveyer" is the "toner delivery means", when this flow originates directly from a magnetic brush, then the magnetic brush is the "toner delivery means". In said flow of charged toner particles, a printhead structure, with printing apertures, is interposed for image-wise modulating said flow of toner particles.

In this document the wording "toner applicator module", is used for the module, comprised in a toner delivery means, that brings charged toner particles to an intermediate member with a surface, comprised in the same toner delivery means, from which a cloud of charged toner particles is generated, i.e. a toner applicator module is a part of the toner delivery means. E.g., in the case that the toner delivery means comprises a charged toner conveyor (CTC), from the surface of which a cloud of charged toner particles is generated, said charged toner particles are brought to the CTC by a "toner applicator module", e.g., a magnetic brush.

The wording "staggered configuration with respect the large substrate" means that the toner delivery means or the toner applicator modules with a width (WTD) smaller than the printing width (PW) are spread over the printing width, essentially parallel with that printing width, so that an image can be printed over the total printing width and that not all the toner delivery means or toner applicator modules are located on a single line.

The wording "substrate" or "image receiving element" can in this document mean a final image receiving element whereon the toner image is printed, as well as an "intermediate image receiving member" used to accept a toner image and to transfer that image to a final image receiving member.

The width of the image receiving substrate (WS) is the dimension of that substrate that is essentially perpendicular to the direction of movement of the substrate in the printer.

The length of the image receiving substrate (WL) is the dimension of that substrate that is essentially parallel to the direction of movement of the substrate in the printer.

DETAILED DESCRIPTION OF THE INVENTION

It was found that a large format printer (large means in this document a surface of at least 0.25 $m^2$ and an image width of at least 30 cm), using a DEP engine device and method, could be produced by using in said DEP engine either at least two, preferably at least three, toner applicator modules or at least two, preferably at least three, toner delivery means, which were staggered with respect to the large substrate.

The advantage of a staggered configuration of the toner applicator modules or the toner delivery means over the total width of a large substrate to be printed lays mainly in the printing speed, which can be made higher and in the possibility to have a rigidly positioned, well outlined printing engine.

A printer according to the present invention, wherein at least two toner applicator modules or at least two toner delivery means are present can be constructed in such a way that any printing width, from 10 cm up to more than, e.g., 5 meter, can be realised. It is however preferred that the printing width (PW) of a printer according to the present invention is at least 40 cm, more preferably at least 60 cm and more preferably 120 cm.

The present invention is further in this document described in detail using possible, but not limitative, specific embodiments of printers according to this invention.

According to a first specific embodiment of the present invention a printhead structure, having a width equal to or larger than the printing width (PW), is used in combination with a charged toner conveyor (CTC), also having a width equal to or larger than the printing width (PW). To the surface of this CTC charged toner particles are applied from different staggered toner applicator means.

In FIG. 1, a schematic perspective view of a possible configuration of a large format printer to this first specific embodiment of this invention is shown. The printer uses a DEP printing engine comprising a toner delivery means (100) wherein three toner applicator modules (103*a, b* and *c*) in a staggered configuration deliver charged toner particles to the surface of a single CTC (104), having a width equal to or larger than the printing width (PW). A single, printhead structure (106), having a width equal to or larger than the printing width (PW) of the printer and comprising a non-staggered set of rows (only one row shown for the sake of simplicity) of printing apertures (107), is used to image-wise deposit toner particles to the substrate (109), having a width (WS) and a length (LS) and that for clarity, is shown as transparent. The arrow A shows the direction of movement of the substrate. The toner applicator means (103*a, b* and *c*) are preferably placed in a slight overlap so that on the surface of the CTC (104) an even and uninterrupted layer of toner particles is created.

The printhead structure used in the configuration of a first specific embodiment of the present invention, described immediately above, can be a flat printhead structure comprising non-staggered sets of rows of printing apertures and the CTC can be constructed so as to have a flat surface (such a CTC has, e.g., been disclosed in U.S. Pat. No. 5,136,311) under the set of rows of apertures. When the CTC is cylindrical, the printhead structure can be curved around the CTC so that over the complete width of the printhead structure a constant distance towards the CTC is obtained, whereby the risk of banding in the image is minimised. An other way to minimise banding with a flat (not bent over the CTC) printhead structure is to adapt the diameter of the CTC to the distance between this CTC and this printhead structure and to the extension of the rows of printing apertures according to the formula (I):

$$R \geq \frac{C^2}{4.25B + 0.25} \quad \text{I}$$

wherein

R is the radius of the cylindrical charged toner conveyor, C is the extension (in mm) of the various sets of printing apertures (107) in the direction of the movement of the receiving substrate (109) measured from the middle of the apertures in the first set to the middle of the apertures in the last set and B is the distance (in mm) between the surface of the CTC and the modular printhead structure (a DEP device incorporating a CTC with a radius adapted to the extension of the rows of printing apertures in the printhead structure has been disclosed in, e.g., EP-A 740 224 and corresponding U.S. Ser. No. 08/634,963).

The staggered toner applicator means, are magnetic brush assemblies applying charged toner particles towards the CTC. The alignment between neighbouring magnetic brush assemblies is such that no visible banding (due to a varying toner layer thickness upon the surface of the CTC) is obtained.

The printhead structure does not have to be a printhead structure, having a width equal to or larger than the printing width (PW) of the printer. It is possible in the configuration of a first specific embodiment of the invention shown in FIG. 1, to use multiple printhead structures, each with one set of rows of printing apertures, that are spread out over the width of the substrate to be printed in a staggered configuration, this gives in fact a modular printhead structure. When several smaller printhead structures are staggered, also the sets of rows of printing apertures are staggered. The advantage of using multiple printhead structures lays mainly in the fact that smaller printhead structures are more easily produced than larger ones, that the printing apertures in smaller printhead structures are more easily kept at a constant distance from the toner delivery means, in this case a CTC, and that in a modular printhead structure defects can more easily and economically be repaired, simply by replacing the defect module. In the case, where the smaller printhead structures are staggered in the same plane above the CTC, the sets of rows of printing apertures are also staggered, and thus are the distances of the various sets of rows of printing apertures to the surface of the single CTC not equal and the risk of banding in the image exists. The banding can be avoided by using a CTC that is essentially flat under the printing apertures (such a CTC can, e.g., be an adaptation of the CTC disclosed in U.S. Pat. No. 5,136,311). The banding can also be avoided, when using a cylindrical CTC, by adapting the diameter of the CTC to the distance between the various sets of printing apertures. Such a CTC has a curvature, R, in the development zone, fulfilling the equation:

$$R \geq \frac{C^2}{4.25B + 0.25}$$

wherein

R is the radius of the cylindrical charged toner conveyor, C is the extension (in mm) of the various sets of rows of printing apertures (107) in the direction of the movement of the receiving substrate (109) measured from the middle of the apertures in the first row of the first set to the middle of the apertures in the last row of the last set and B is the distance (in mm) between the surface of the CTC and the modular printhead structure.

It is also possible, when using in the first specific embodiment of the present invention various smaller printhead structures instead of a page-wide printhead structure, to position the smaller printhead structures in a staggered configuration around the CTC in different planes so that the distances between every set of rows of printing apertures and the surface of the CTC are kept constant. When doing so it may be necessary to curve the path of the image receiving substrate around the CTC, and to introduce more than one back electrode to manufacture a workable printer. When the smaller printhead structures are placed in different planes around the CTC, it is preferred to mount the various printhead structures in such a way that there is contact between each of these printhead structures and this CTC, by doing so no problem occurs regarding the distance between CTC and printhead structure.

Figure 2:
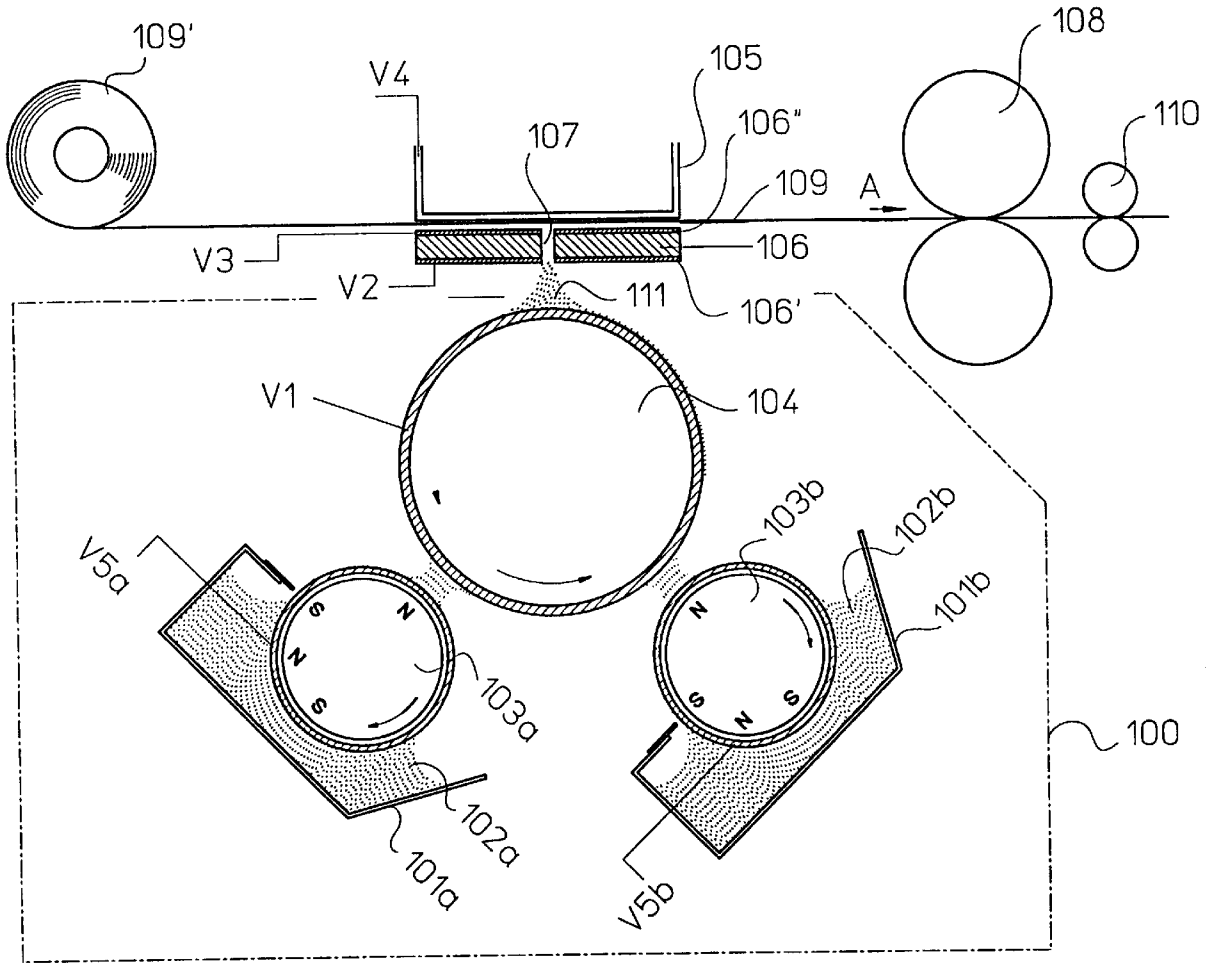
FIG. 2 is a schematic lateral view of a possible configuration of a printer according to a first specific embodiment of the present invention.

In FIG. 2, a more detailed lateral view of a printer according to the possible configuration of a printer according to the first specific embodiment to the present invention as shown in FIG. 1 is given. The DEP printing engine comprises:

(i) a toner delivery means with a single charged toner conveyor (CTC) (104) (the wording "charged toner conveyor" is used throughout this document to indicate a conveyor for charged toner particles), carrying charged toner particles on its surface, providing a cloud of toner particles (toner cloud) (111) in the vicinity of printing apertures (107), (this toner cloud (111) is being not shown in FIG. 1), (ii) toner applicator modules (103*a* and *b*), in this case being magnetic brush assemblies. These magnetic brush assemblies apply an amount of charged toner particles on the surface of the single charged toner conveyor (104), each of these magnetic brushes being accommodated in a container (101*a* and *b*) for developer (102*a* and *b*), (iii) a back electrode (105), (iv) a printhead structure (106), made from a plastic insulating film, coated on both sides with a metallic film. The printhead structure (106) comprises one continuous electrode surface, hereinafter called "shield electrode" (106'), facing in the shown configuration the toner delivering means and a complex addressable electrode structure, hereinafter called "control electrode" (106"), around printing apertures (107), facing, in the shown configuration, the toner receiving member in this DEP printing engine. The location and/or form of the shield electrode (106') and the control electrode (106") can, in other configurations of a DEP printing engine according to the first specific embodiment of this invention, be different from the location shown in FIG. 2.

(v) conveyor means (108), to convey an image receiving member in the form of a web (109), withdrawn from a roll (109'), for receiving image-wise deposited toner particles, between this printhead structure and this back electrode in the direction indicated by arrow A, and (vi) means for fixing (110) this toner onto this image receiving member.

In FIG. 2, V1, V2, V3, V4 and V5 indicate the different voltages applied to the different parts of the DEP printing engine, thus creating the necessary electrical fields for the operation of the device. Further on the role of the different voltages, which is in essence equal for all embodiments of the present invention is described.

Figure 3:
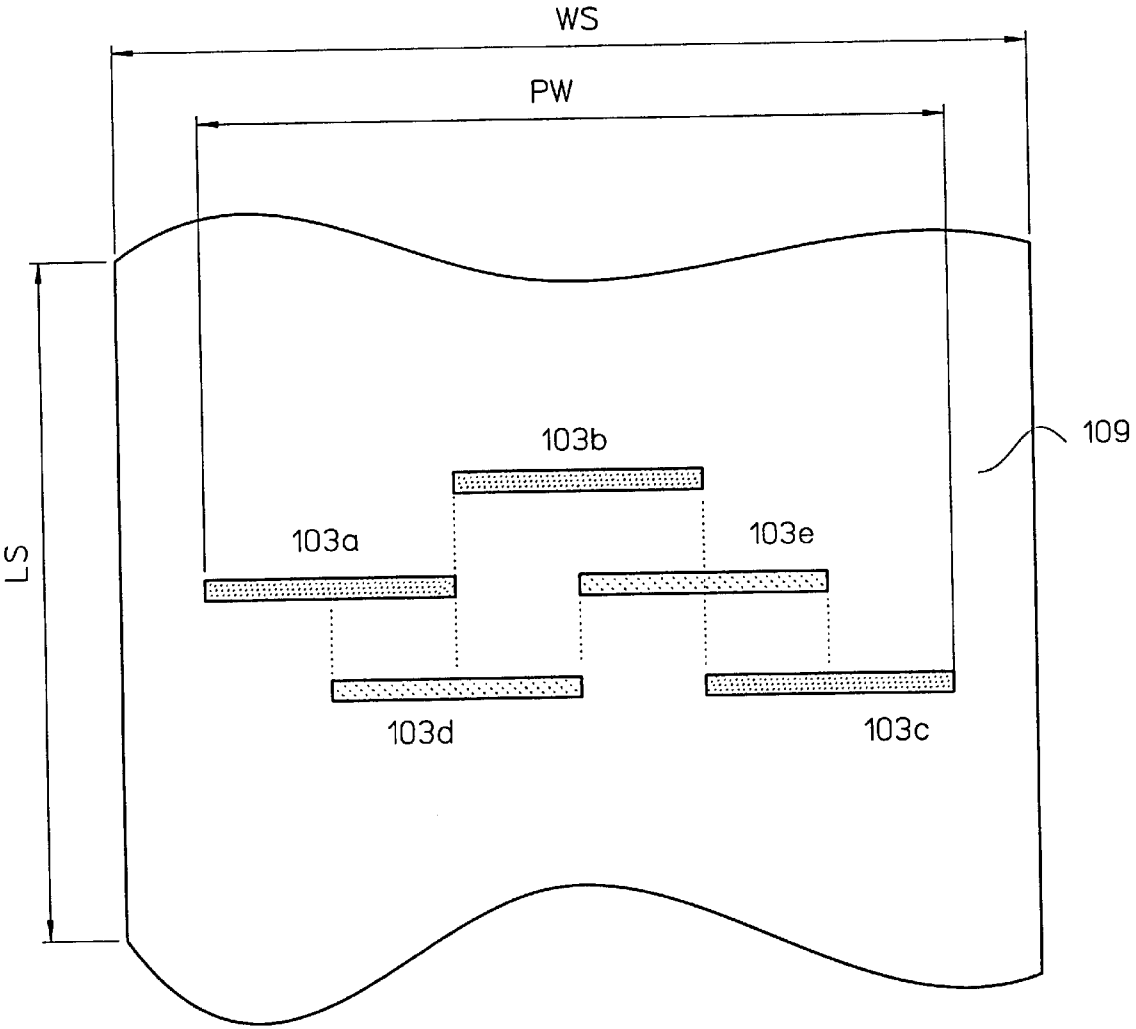
FIG. 3 shows the projection in the plane of the image receiving substrate of the toner applicator means, in an other possible configuration of a printer according to a first specific embodiment of the present invention.

In a further possible configuration of a printer according to the first specific embodiment of this invention a more complex set of five toner applicator modules (e.g., five magnetic brush assemblies) is used to bring charged toner particles to the CTC. A projection of the five toner applicator modules (103*a, b, c, d* and *e*) in the plane of the large substrate (109), having a width (WS) and a length (LS) is shown in FIG. 3. (The CTC itself is not shown in that figure). Three of toner applicator means (103*a, b* and *c*) are positioned in a staggered configuration, without overlap, so as to obtain an homogeneous toner density upon the charged toner conveyor. Two extra toner applicator modules (103*d* and *e*) are staggered with respect to the first set of three toner applicator modules, with a certain overlap, so that charged toner particles are applied to the centre of the charged toner conveyor from two separate toner applicator modules. I.e. toner applicator module 103*d* overlaps for 50% with both toner module 103*a* and 103*b* and toner applicator module 103*e* overlaps 50% with both toner module 103*b* and 103*c*. It was found that this arrangement results in an even better homogeneity of the charged toner layer thickness upon the charged toner conveyor. The extension of the set of toner delivery means gives the printing width (PW) of the printer.

It is clear for those skilled in the art that further modifications can still be made to the first specific embodiment of this invention without departing from the scope of this invention.

The toner applicator modules in the first specific embodiment of the invention can be magnetic brush assemblies, using either a multi-component developer, comprising magnetic carrier particles and non-magnetic toner particles or a mono-component magnetic developer. The applicator modules can also be applicators for non- magnetic mono-component developer.

When the toner applicator modules, shown in FIG. 3, are magnetic brush assemblies, it is possible to change the voltage applied to the sleeve of this two last magnetic brush assemblies (i.e. toner applicator modules 103*d* and *e*) with respect to the three first ones, so that the charged toner layer thickness upon the charged toner conveyor is merely ruled by the first set of three magnetic brush assemblies, while the homogeneity of the charged toner layer thickness at the neighbouring positions corresponding to the three different sets of magnetic brush assemblies is improved by the introduction of the second set of magnetic brush assemblies.

In a very interesting modification of this first specific embodiment of the present invention, the toner applicator modules (103) are magnetic brushes and some or each of the staggered magnetic brush configurations are constructed such as to comprise two separate magnetic brush assemblies, namely a pushing and a pulling magnetic brush assembly. By push-pull magnetic brushes are meant two different magnetic brushes depositing a layer of toner particles upon the charged toner conveyor from a multi-component developer (e.g. a two-component developer, comprising carrier and toner particles wherein the toner particles are tribo-electrically charged by the contact with carrier particles or 1.5 component developers, wherein the toner particles get tribo-electrically charged not only by contact with carrier particles, but also by contact between the toner particles themselves). Such developers have been described in U.S. Pat. No. 5,359,147. The first of the two different magnetic brushes is a pushing magnetic brush, used to jump charged toner particles to the CTC and being connected to a DC-source with the same polarity as the toner particles. The second of the two magnetic brushes is a pulling magnetic brush, used to remove toner particles from the CTC and connected to a DC-source with a polarity opposite to the polarity of the toner particles. By adapting the respective voltages applied to the surface of the respective sleeves the resulting push/pull mechanism provides a way of applying a highly homogeneous layer of well behaved charged toner particles upon the charged toner conveyor. This configuration has the advantage that charged toner upon the surface of the CTC that has not been used in the image-wise deposition step is removed from the CTC so that only fresh and well behaved charged toner is propelled through the printhead apertures.

In still another configuration of a printer according to the first specific embodiment of the invention, a second separate CTC (charged toner conveyor) with the same width as the first CTC is used and an alternating electric field is applied between the two charged toner conveyors so that the charged toner is propelled between the two roller structures of the CTC's yielding a more uniform distribution of charged toner particles upon the first charged toner conveyor in the neighbourhood of the apertures in the printhead structure.

In a second specific embodiment of the invention a printer is provided, with printing width (PW), for printing a toner image on a substrate comprising a DEP printing engine, having

- a toner delivery means (100) having a surface whereon charged toner particles are present for providing a flow of said toner particles from said surface to said substrate,
- a printhead structure (106) with printing apertures (107) and control electrodes (106"),interposed in said flow of toner particles for image-wise controlling said flow, characterised in that:
- i) said printhead structure comprises at least two staggered sets of row of printing apertures having a width (WR) smaller than said printing width (PW), and
- ii) with each of said at least two rows of printing apertures a toner delivery means is associated.

Figure 4:
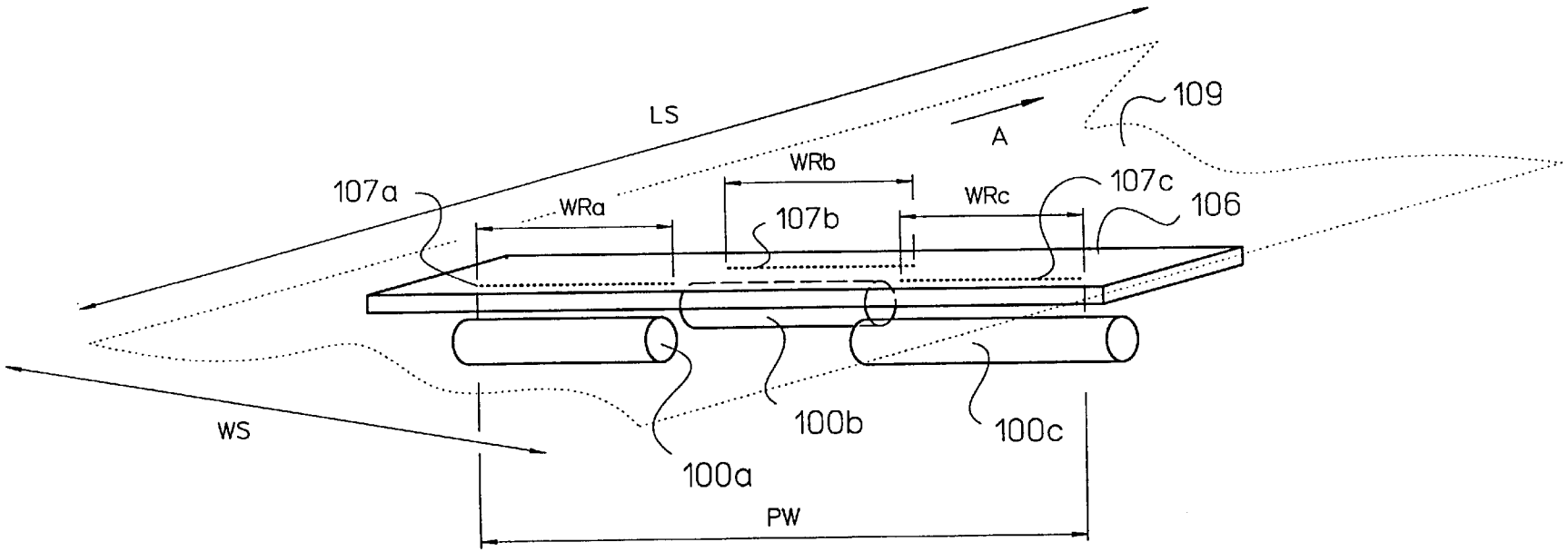
FIG. 4 is a schematic illustration of a possible configuration of a printer according to a second specific embodiment the present invention.

FIG. 4 shows a schematic perspective view of a possible configuration of a printer according to a second specific embodiment of the present invention. A single printhead structure (106), having a width equal to or larger than the printing width (PW) of the printer, comprises multiple staggered sets of rows of printing apertures (107*a, b* and *c*), each of the staggered sets of rows of printing apertures having a width (WR) smaller that the printing width (PW). Under each of the staggered rows a toner delivery means (100*a, b* and *c*) is present. Via each toner delivery means and the set of rows of printing apertures (in the figure only one row of printing apertures is shown per set) associated there with, charged toner particles are image-wise deposited on to the image receiving member (109), having a width (WS) and a length (LS) and that for clarity, is shown as a transparent substrate. The arrow A shows the direction of movement of the image receiving member.

Figure 5:
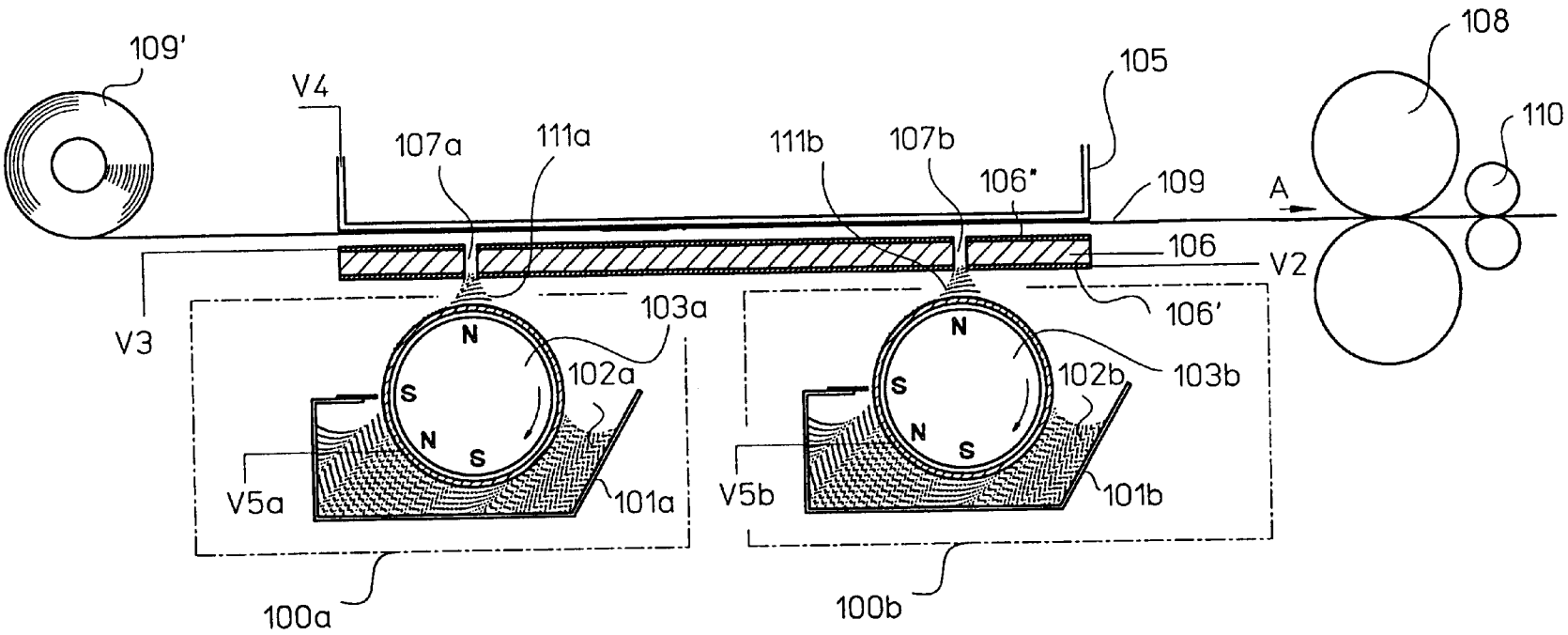
FIG. 5 is a schematic lateral view of a possible configuration of a printer according to a second specific embodiment of the present invention.

FIG. 5 shows a more detailed lateral view of the configuration of a printer according to the second specific embodiment of this invention, shown in FIG. 4.

The DEP device comprises:

(i) toner delivery means (100*a,b*), each comprising a container (101*a* and *b*) for developer (102*a* and *b*) and a magnetic brush assembly (103*a* and *b*); between each of the magnetic brush assemblies and the set of rows of printing apertures (107*a, b*) in the printhead structure (106) associated with the respective toner delivery means a cloud of toner particles (111*a, b*) is produced, (ii) a back electrode (105), (iii) a printhead structure (106), made from a plastic insulating film, coated on both sides with a metallic film. The printhead structure (106) comprises one continuous electrode surface, hereinafter called "shield electrode" (106'), facing, in the shown configuration, the toner delivering means and a complex addressable electrode structure, hereinafter called "control electrode" (106"), around printing apertures (107), facing, in the shown configuration, the toner receiving member. The location and/or form of the shield electrode (106') and the control electrode (106") can, in other configurations of a printer according to the second specific embodiment of this invention, be different from the location shown in FIG. 5.

(v) conveyor means (108), to convey an image receiving member, in the form of a web (109), withdrawn from a roll (109'), between the printhead structure and the back electrode in the direction indicated by arrow A, for receiving the toner image, and (vi) means for fixing (110) the toner onto the image receiving member.

In FIG. 5, V2, V3, V4 and V5 indicate the different voltages applied to the different parts of the DEP device, thus creating the necessary electrical fields for the operation of the device. Further on the role of the different voltages, which is in essence equal for all embodiments of the present invention is described.

The toner cloud (111*a* and *b*), in the possible configuration of the second specific embodiment of the invention shown in FIG. 5, is directly extracted from a magnetic brush. The developer used can be a mono-component magnetic developer or a multi-component developer comprising magnetic carrier particles and non-magnetic toner particles.

In an other configuration of the second specific embodiment of the present invention, the toner delivery means (100*a, b* and *c*), shown in FIG. 4, comprise CTC's on which a layer of toner particles are deposited by toner applicator modules, as described under the first specific embodiment of the invention, and the cloud of toner particles (111) is created between the CTC's and the set of rows of printing apertures associated with each CTC.

When using magnetic brush assemblies to directly create the toner clouds, the magnetic brush assemblies make contact over their magnetic hairs with the printhead structure that was stretched over a rigid four-bar frame as described in EP-A 712 056.

The FIGS. 2 and 5, each schematically illustrating a printer according to the present invention, show printers wherein the substrate (109) to be printed is a web. It is evident that a printer, comprising staggered toner applicator modules or toner delivery means, capable to print on sheet material is within the scope of the present invention.

The DEP devices, described herein before in detail, use a printhead structure wherein both a shield electrode and control electrodes, also DEP devices wherein a printhead structure comprising no shield electrode and only control electrodes are useful in the present invention.

In FIGS. 1, 3 and 4, the printing width (PW) is shown to be smaller than the width (WS) of the substrate to be printed. A printer according to the present invention can have a printing width smaller than, equal to or larger than the width of the substrate to be printed.

According to a third specific embodiment, a printer according to the present invention, comprises either a DEP printing engine as described in the first specific embodiment of the invention or as described in the second specific embodiment of the invention, integrated in a moving shuttle, said shuttle having, preferably, a printing width (swath width SWS) of at least 30 cm, more preferably larger than 40 cm, so that a large format image is written in separate image bands (swaths). The shuttle, comprising a DEP printing engine, is travelling over the image receiving member in a first direction, preferably a direction that is essentially parallel to the width of the substrate to be printed, thus perpendicular to the length of the substrate. After having printed a single band over the width of the image receiving member, the image receiving member is moved in a direction different from said first direction, over a length corresponding to the width of the printhead structure and toner delivering means. Thus, the third specific embodiment of the invention encompasses a printer for large format printing, wherein a large substrate is movable in one direction and a shuttle comprising a DEP printing engine is movable in a second direction, the second direction being different from the first direction, the DEP printing engine comprising a printhead structure (106) comprising printing apertures (107) and control electrodes (106"), and a toner delivery means (100) and wherein the toner delivery means comprises at least two toner applicator modules (103), positioned in a staggered configuration.

The invention further encompasses a printer for large format printing, wherein a large substrate is movable in one direction and a shuttle comprising a DEP printing engine is movable in a second direction, the second direction being different from the first direction, the DEP printing engine comprising a printhead structure (106) comprising printing apertures (107) and control electrodes (106"), and a toner delivery means (100) and wherein the printhead structure (106), comprises at least two staggered sets of rows of printing apertures and each of the staggered sets of rows of printing apertures is combined with a toner delivery means (100).

In a printer according to the third specific embodiment of the invention, a large substrate is preferably movable in one direction, and a shuttle is movable in a second direction, the second direction being essentially perpendicular to the first direction.

In a further preferred embodiment the shuttle, comprising DEP devices as describe above, is arranged so that the width (WTD) of the staggered toner delivery means or toner applicator modules is essentially perpendicular to the width of the substrate to be printed and parallel to the direction of movement of the shuttle.

The third specific embodiment of the invention provides a printer with a shuttle comprising a printing engine with rather large printing width. The shuttle in the third specific embodiment of the invention has a printing width (i.e. the swath width of the shuttle, SWS) of at least 40 cm, preferably 60 cm and more preferably 120 cm. The shuttle, comprising a wide DEP printing engine according to this invention, moves preferably in a direction essentially perpendicular to the movement of a large paper web so that images of very large dimension (e.g. >5 meter width) can be obtained with a very fast printing speed (e.g. >500 $m^2$/hour) while keeping the shuttling speed fairly low.

In a shuttle printer according to the present invention, both types of DEP engine, as described in the first and second specific embodiment of the invention can be incorporated in said shuttle. And thus two kinds of printers belong also to this invention:

1. a printer comprising means for moving said substrate a first direction, means for moving a shuttle having a swath width (SWS) in a second direction, different from said first direction, said shuttle carrying a DEP engine having a toner delivery means (100) having a surface whereon charged toner particles are present for providing a flow of said toner particles from said surface to said substrate, a printhead structure (106) with printing apertures (107) and control electrodes (106"),interposed in said flow of toner particles for image-wise controlling said flow, wherein said toner delivery means comprises a number n, equal to or larger than 2, of toner applicator modules (103), each having a width (WTD) smaller than said swath width (SWS), at least two of said number n of toner applicator modules being positioned in a staggered configuration with respect to said substrate and 2. a printer, comprising means for moving said substrate a first direction, means for moving a shuttle having a swath width (SWS) in a second direction, different from said first direction, said shuttle carrying a DEP engine having a toner delivery means (100) having a surface whereon charge toner particles are present for providing a flow of said toner particles from said surface to said substrate, a printhead structure (106) with printing apertures (107) and control electrodes (106"),interposed in said flow of toner particles for image-wise controlling said flow, wherein said printhead structure comprises at least two staggered sets of row of printing apertures having a width (WR) smaller than said swath width (SWS), and with each of said at least two rows of printing apertures a toner delivery means is associated.

The back electrode (105) of DEP devices according to all embodiments of this invention, can also be made to co-operate with the printhead structure, the back electrode being constructed from different styli or wires that are galvanically insulated and connected to a voltage source as disclosed in e.g. U.S. Pat. No. 4,568,955 and U.S. Pat. No. 4,733,256. The back electrode, co-operating with the printhead structure, can also comprise one or more flexible PCB's (Printed Circuit Board). In all embodiments of this invention the back electrode can be a page-wide back electrode or it can be various smaller back electrodes spread out over the total width of the large substrate to be printed. In case of a shuttling printer, using DEP engines according to this invention, the back electrode can shuttle with the engine or can be an electrode having a width equal to the maximum width of the printable substrates and being positioned in a steady position.

A DEP printing engine in a printer according to all embodiments of the present invention can also operate without a back electrode. In that case, on the substrate to be printed a conductive layer is present and an electrical field, creating a flow of charged toner particles, is applied between the conductive layer and the toner delivery means, such a DEP device has been disclosed in European Application 96202228, field on Aug. 8, 1996.

Any DEP printing engine makes it possible to image-wise deposit toner particles by applying various electrical fields between the different parts of such a DEP device. Reverting to FIG. 2, between the printhead structure (106) and the charged toner conveyor (104), as well as between the charged toner conveyor and the magnetic brush assembly (103) as well as between the control electrode around the printing apertures (107) and the back electrode (105) behind the toner receiving member (109) as well as on the single electrode surface or between the plural electrode surfaces of the printhead structure (106) different electrical fields are applied. In the specific embodiment of a device, useful for a DEP method, shown in FIG. 2. voltage V1 is applied to the sleeve of the charged toner conveyor 104, voltage V2 to the shield electrode 106', voltages $V3_0$ up to $V3_n$ for the control electrode (106"). The value of V3 is selected, according to the modulation of the image forming signals, between the values $V3_0$ and $V3_n$, on a time-basis or grey-level basis. Voltage V4 is applied to the back electrode behind the toner receiving member. In other configurations of the present invention multiple voltages $V2_0$ to $V2_n$ and/or $V4_0$ to $V4_n$ can be used. Voltage V5 is applied to the sleeve of the magnetic brush assemblies.

The printhead structure used in any embodiment of a DEP device according to the present invention can also be a mesh shaped structure as disclosed in, e.g., EP-A 390 847; it can comprise printing apertures in slit form as disclosed in, e.g., EP-A-780 740. In fact any printhead structure known in the art can be combined with a toner delivery means in DEP devices according to the present invention.

Several types of magnetic carrier particles can be used with a toner delivery means in DEP devices according to the invention as described in European patent application EP-A 675 417.

Any kind of toner particles, black, coloured or colourless, can be used in DEP devices according to the present invention. It is preferred to use toner particles as disclosed in European patent application EP-A 715 218, that is incorporated by reference.

A DEP device according to any embodiment of this invention, using the above mentioned marking particles can be addressed in a way that enables it to give black and white. It can thus be operated in a "binary way", useful for black and white text and graphics and useful for classical bi-level half-toning to render continuous tone images. A DEP device according to any embodiment of the present invention is especially suited for rendering an image with a plurality of grey levels. Grey level printing can be controlled by either an amplitude modulation of the voltage V3 applied on the control electrode 106" or by a time modulation of V3. By changing the duty cycle of the time modulation at a specific frequency, it is possible to print accurately fine differences in grey levels. It is also possible to control the grey level printing by a combination of an amplitude modulation and a time modulation of the voltage V3, applied on the control electrode.

The combination of a high spatial resolution, obtained by the small-diameter printing apertures (107), and of the multiple grey level capabilities typical for DEP, opens the way for multilevel half-toning techniques, such as e.g. described in the EP-A 634 862. This enables the DEP device, according to the present invention, to render high quality images.

EXAMPLES

The DEP device

A printhead structure (106) was made from a polyimide film of 50 $\mu$m thickness, double sided coated with a 17.5 $\mu$m thick copper film. The printhead structure (106) had four rows of printing apertures. On the back side of the printhead structure, facing the receiving member substrate, a rectangular shaped control electrode (106") was arranged around each aperture. Each of the control electrodes was individually addressable from a high voltage power supply. On the front side of the printhead structure, facing the toner delivery means, a common shield electrode (106') was present. Above the shield electrode a 200 $\mu$m thick plastic polyurethane member was present. The printing apertures were rectangles of 400 by 150 $\mu$m. The total width of the rectangular copper control electrodes was 600 by 250 μm, their internal aperture also being 400 by 150 μm. The size of the aperture in the common shield electrode was 600 by 250 μm. The total width of the printhead structure having four rows of printing apertures was 90 cm. The printhead structure was fabricated in the following way. First of all the control electrode pattern was etched by conventional copper etching techniques. Then the shield electrode pattern was etched by conventional copper etching techniques. The polyurethane layer was laminated on top of the shield electrode layer. The apertures were made by a step and repeat focused excimer laser burning making use of the control electrode patterns as focusing aid. After excimer burning the printhead structure was cleaned by a short isotropic plasma etching cleaning. Finally a thin coating of PLASTIK70,(trade name) commercially available from Kontakt Chemie, was applied over the control electrode side of the printhead structure.

A charged toner conveyor of 90 cm width was used. The charged toner conveyor was made of copper and had a diameter of 10 cm .

Charged toner particles were applied towards the charged toner conveyor from 3 different magnetic brush assemblies, each of them having a width of 30 cm. These magnetic brush assemblies (103) were constituted of the so called magnetic roller, which in the case contained inside the roller assembly a fixed magnetic core, showing 9 magnetic poles of 50 mT (500 Gauss) magnetic field intensity. The magnetic roller contained also a sleeve, fitting around the magnetic core, and giving to the magnetic brush assembly an overall diameter of 20 mm. The sleeve was made of finely roughened stainless steel.

A scraper blade was used to force developer to leave the magnetic roller. And on the other side a doctoring blade was used to meter a small amount of developer onto the surface of the magnetic brush assembly. The magnetic brush assemblies were connected to a high voltage power supply and the charged toner conveyor was connected to an AC power supply with a square wave oscillating field of 600 V at a frequency of 3.0 kHz with 0 V DC-offset. The three magnetic brush assemblies were staggered in such a way that an homogeneous amount of charged toner particles could be applied towards the charged toner conveyor. The alignment was tuned by translating the magnetic brush assemblies in a direction parallel towards the surface of the charged toner conveyor until visually no banding at all was observed.

The developer

A macroscopic "soft" ferrite carrier consisting of a MgZn-ferrite with average particle size 50 μm a magnetisation at saturation of 36 $\mu Tm^3/kg$ (29 emu/g) was provided with a 1 μm thick acrylic coating. The material showed virtually no remanence.

The toner used for the experiment had the following composition: 97 parts of a co-polyester resin of fumaric acid and propoxylated bisphenol A, having an acid value of 18 and volume resistivity of $5.1\times10^{16}$ Ω.cm was melt-blended for 30 minutes at 110° C. in a laboratory kneader with 3 parts of Cu-phthalocyanine pigment (Colour Index PB 15:3). A resistivity decreasing substance— having the following structural formula: $(CH_3)_3N^+C_{16}H_{33}Br^-$—was added in a quantity of 0.5% with respect to the binder. It was found that—by mixing with 5% of the ammonium salt—the volume resistivity of the applied binder resin was lowered to $5\times10^{14}$ Ω.cm.

After cooling, the solidified mass was pulverised and milled using an ALPINE Fliessbettgegenstrahlmühle type 100AFG (trade name) and further classified using an ALPINE multiplex zig-zag classifier type 100MZR (trade name). The resulting particle size distribution of the separated toner, measured by Coulter Counter model Multisizer (trade name), was found to be 6.3 μm average by number and 8.2 μm average by volume. In order to improve the flowability of the toner mass, the toner particles were mixed with 0.5% of hydrophobic colloidal silica particles (BET-value 130 $m^2/g$).

An electrostatographic developer was prepared by mixing this mixture of toner particles and colloidal silica in a 4% ratio (w/w) with carrier particles. The tribo-electric charging of the toner-carrier mixture was performed by mixing this mixture in a standard tumbling set-up for 10 min. The developer mixture was run in the development unit (magnetic brush assembly) for 5 minutes, after which the toner was sampled and the tribo-electric properties were measured, according to a method as described in the above mentioned EP-A 675 417, giving q=−7.1 fC, q as defined in that application.

The printhead structure was bent over the charged toner conveyor, making frictional contact over the polyurethane member with the charged toner particles on the surface of the CTC. The distance between the surface of the charged toner conveyor and the sleeve of the different magnetic brush assemblies (103), was set at 700 μm. The distance between the back electrode (105) and the back side of the printhead structure (106) (i.e. control electrodes 106") was set to 500 μm and the paper travelled at 3 cm/sec. To the individual control electrodes an (image-wise) voltage V3 between 0 V and −300 V was applied. The shield electrode was grounded: V2=0 V. The back electrode (105) was connected to a high voltage power supply of +1500 V. To the sleeve of the charged toner conveyor an AC voltage of 600 V at 3.0 kHz was applied, without DC offset. To the sleeve of the different magnetic brush assemblies a DC voltage of −200 V was applied.

It must be clear to those skilled in the art that numerous modifications can be made to the concept without departing from the spirit of the invention.

What is claimed is:

1. A printer, with printing width, PW, for printing a toner image on a substrate, said substrate having a width, WS, and a length, having a DEP printing engine, said DEP engine comprising:

a conveyer for charged toner particles, CTC, having a moving surface whereon charged toner particles are present for providing a flow of said toner particles from said surface to said substrate;

a printhead structure with a single set of printing apertures extending continuously across said printing width, PW, and control electrodes associated with said printing apertures, interposed in said flow of toner particles for image-wise controlling said flow of toner particles, and at least two toner applicator modules, separate from said printhead structure, each having a width, WTD, smaller than said printing width PW, at least two of said toner applicator modules being positioned in staggered configuration with respect to said CTC, said toner applicator modules being offset from each other in the direction of said CTC movement and in a direction transverse thereto, and applying a layer of charged toner particles onto the surface of said CTC, said layer extending on said surface over a width equal to or larger than said printing width, PW.

2. A printer according to claim 1, wherein said printing width PW is at least 40 cm.

3. A printer according to claim 1, wherein each of said at least two toner applicator modules comprises a magnetic brush assembly.

4. A printer according to claim 3, wherein said magnetic brushes apply toner to said CTC from a multi-component developer comprising magnetic carrier particles and non-magnetic toner particles.

5. A printer according to claim 3, wherein said magnetic brushes apply toner to said CTC from a magnetic mono-component developer.

6. A printer according to claim 1, wherein said at least two toner delivery means comprise non-magnetic mono-component applicator means.

7. A printer according to claim 1, wherein a page-wide back electrode is present and said substrate is present between said printhead structure and said back electrode.

8. A printer, for printing a toner image on a substrate, having a width, WS, and a length, LS, comprising:

a transport for moving said substrate a first direction;

a DEP printing engine having a printing width, PW, mounted on a shuttle for movement in a second direction, different from said first direction, said DEP engine having:

a conveyer for charged toner particles, having a moving surface whereon charged toner particles are present for providing a flow of said toner particles from said surface to said substrate, a printhead structure with a single set of printing apertures extending continuously across said printing width, PW, and control electrodes associated with said printing apertures, interposed in said flow of toner particles for image-wise controlling said flow of tone particles; and at least two toner applicator modules, separate from said printhead structure, each having a width WTD, smaller than said printing width PW, at least two of said toner applicator modules being positioned in staggered configuration with respect to said moving surface of said CTC, said toner applicator modules being offset from each other in the direction of said CTC movement and in a direction transverse thereto, and applying a layer of charged toner particles onto the surface of said CTC, said layer extending on said surface over a width equal to or larger than said printing width, PW.

9. A printer, with a printing width, PW, for printing a toner image on a substrate having a DEP printing engine, said DEP printing engine comprising:

a printhead structure comprising at least two staggered sets of printing apertures and control electrodes associated therewith for image-wise controlling a flow of toner particles through said apertures, each of said sets of printing apertures extending over a separate portion of said printing width PW and having a width, WR, smaller than said printing width, PW, said sets of printing apertures collectively extending in staggered arrangement across said printing width, PW; and means for delivering toner particles associated with each of said sets of printing apertures, each of said particle delivery means having a surface whereon charged particles are present and arranged to provide said flow of toner particles from said surface through said apertures to said substrate.

10. A printer according to claim 9, wherein said printing width, PW, is at least 40 cm.

11. A printer according to claim 9, wherein said printhead structure has a width equal to or larger than said printing width.

12. A printer according to claim 9, wherein said means for delivering toner particles each comprise a conveyor for charged toner particles, CTC, and a toner applicator module for applying a layer of toner particles to said CTC.

13. A printer according to claim 9, wherein said means for delivering toner particles are magnetic brush assemblies.

14. A printer according to claim 9, wherein a page-wide back electrode is present and said substrate is present between said printhead structure and said back electrode.

15. A printer, for printing a toner image on a substrate having a width, WS, and a length, LS, comprising:

a transport for moving said substrate in a first direction;

a DEP print engine having a printing width, PW, mounted on a shuttle for movement in a second direction, different from said first direction, said DEP engine having:

a printhead structure comprising at least two sets of printing apertures, staggered in said second direction, and control electrodes associated therewith for image-wise controlling a flow of toner particles through said apertures, each of said sets of printing apertures extending over a separate portion of said printing width PW and having a width, WR, smaller than said printing width PW, said sets of printing apertures collectively extending across said printing width, PW; and means for delivering toner particles associated with each of said sets of printing apertures, each of said particle delivery means having a surface whereon charged particles are present and arranged to provide said flow of toner particles from said surface through said apertures to said substrate.

16. A printer according to claim 15, wherein said printhead structure has a width equal to or larger than said swath width.

17. A printer according to claim 15, wherein said means for delivering toner particles each comprise a conveyor for charged toner particles, CTC, and a toner applicator module for applying a layer of toner particles to said CTC.

* * * * *